United States Patent [19]

Kaufman

[11] 4,453,389

[45] Jun. 12, 1984

[54] PROTECTIVE DEVICE FOR THE DOOR-LOCK

[76] Inventor: Lazar Kaufman, 454 Fort Washington Ave., Apt. 50A, New York, N.Y. 10033

[21] Appl. No.: 87,734

[22] Filed: Oct. 24, 1979

[51] Int. Cl.[3] ..... E05B 63/00

[52] U.S. Cl. ..... 70/416; 70/1.5

[58] Field of Search ..... 70/1.5, 1.7, 416, 422, 70/418, 417

[56] References Cited

U.S. PATENT DOCUMENTS 2,042,026 5/1936 Schoorel ..... 70/422

3,961,504 6/1976 Sprecher ..... 70/422

*Primary Examiner*—Robert L. Wolfe

*Attorney, Agent, or Firm*—Kenyon & Kenyon

[57] ABSTRACT

Protective apparatus for a lock and a lock including such apparatus are disclosed. The protective apparatus comprises a plate-like element adapted to be added to a standard lock without requiring any mounting structure not already present in the lock. A spring causes the plate-like element to move or pivot when the connecting bar of the lock is removed to block the opening through which the lock connecting bar extends into the housing. Thereby, the plate prevents insertion of a tool such as a screwdriver into the lock. In some embodiments, the protective apparatus locks the bolt when the connecting bar is removed.

63 Claims, 15 Drawing Figures

PROTECTIVE DEVICE FOR THE DOOR-LOCK

BACKGROUND OF THE INVENTION

The present invention relates to lock apparatus, in general, and in particular to protective apparatus for lock apparatus and lock apparatus including protective apparatus.

SUMMARY OF THE INVENTION

A protective device or apparatus for a door lock is provided which is placed into the lock and is able to protect the slot through which the connecting bar of the lock extends to the lock mechanism in the housing from the lock cylinder when the connecting bar is removed. The protective device can also lock the bolt when the connecting bar is removed.

DETAILED DESCRIPTION OF THE PREFERRED EMBODIMENTS

The protective device or apparatus of the invention is intended to obstruct the opening to the bolt mechanism of the lock when the cylinder and the connecting bar of the lock are destroyed, i.e., the connecting bar is removed from the opening to the bolt mechanism, thus preventing actuation of the lock by a screwdriver inserted into the bolt mechanism through the opening. The protective device is an independent device which is inserted into a standard lock without requiring changes to the lock.

Figure 1:
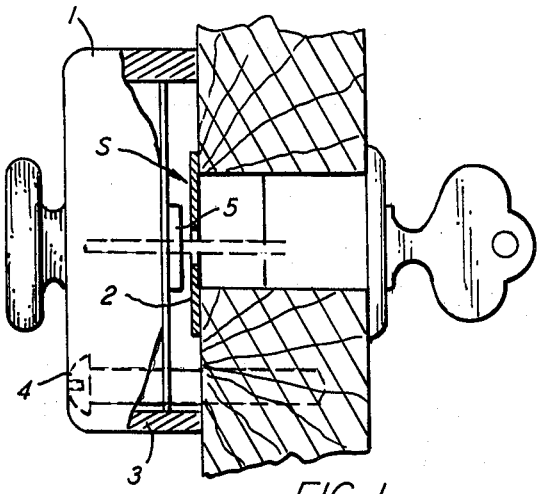
FIG. 1 is a section view of a lock mounted to a door showing the free space between the door and the lock.

The small free space "S" (FIG. 1) between a standard lock 1 and a door and between the lock and a backplate 2 used to fasten the lock cylinder to the door poses a problem to providing such a device because the free space is insufficient to accommodate any device having an accompanying case or housing. A similar problem arises if a protective device is to be inserted into the lock case or housing in which the bolt mechanism of the lock is disposed. Depending on where a protective device of the invention is placed, it can provide the following security. If it is placed between the lock and the door, then the protective device is able to obstruct the slot or opening of the lock through which the connecting bar of the lock is inserted. If the protective device completely or partially is placed into the lock housing, it is able to lock the bolt of the lock when the cylinder with its connecting bar are removed.

According to the invention, these problems are solved by using the walls 3 of the lock body or housing, the lock screws 4, and/or the projection 5 or other rigid parts of that lock without otherwise fastening the device to the lock. The protective device is realized by parts whose movement, and initial and terminal positions, are determined by means of the lock housing walls, the lock screws and other parts of a standard lock to which a protective device is mounted. Different embodiments of protective devices are described below.

Figure 2:
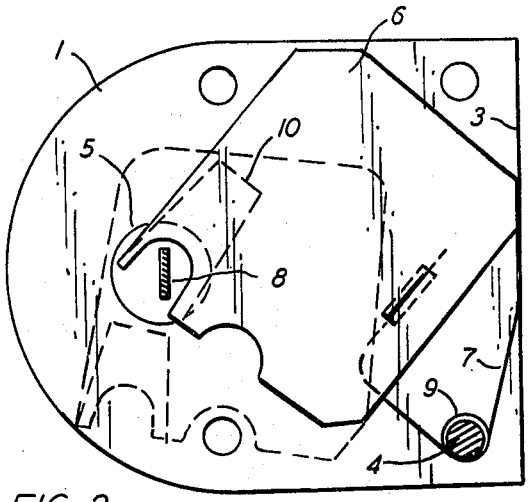
FIG. 2 is a plan schematic view of the side of the lock of FIG. 1 facing the door showing one embodiment of a protective device which is rotated about a screw of the lock by a spring and locked in the rotated position.

FIG. 2 shows an embodiment of a protective device in which the blind or plate-like element 6 together with a spring 7, which is fastened to the blind, is inserted into the free space "S" (FIG. 1) between the lock 1 and the door. The blind 6 is urged against the connecting bar 8 of the lock by the spring 7. One of the screws 4 of the lock passes through the coil 9 of the spring 7. When the cylinder together with the connecting bar are removed, then the blind 6 urged by means of the spring 7 pivots to block the slot or opening through which the connecting bar 8 enters into the housing, thus preventing a screwdriver from being inserted into the slot which could otherwise be used to unlock the lock. A flat spring 10 fastened to the blind engages the projection 5 of the lock and locks the blind 6 in its rotated, terminal position, making it impossible to move the blind 6 by a sharp tool in an attempt to open the slot of the lock.

Figure 3:
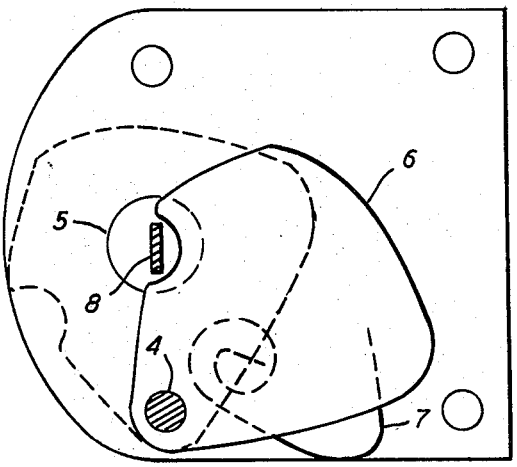
FIG. 3 is a plan schematic view of the side of the lock of FIG. 1 facing the door showing another embodiment of a protective device which is rotated about a screw of the lock by a spring and locked in the rotated position.

FIG. 3 shows an embodiment of a similar protective device in which a screw of the lock passes through a hole of the blind. Similar parts in FIGS. 2 and 3 are marked with the same numbers. Locking of the blind 6 in its terminal position in FIG. 3 is accomplished by the free end of the spring 7 which engages the housing when the blind is in its terminal position shown in broken lines.

Figure 4:
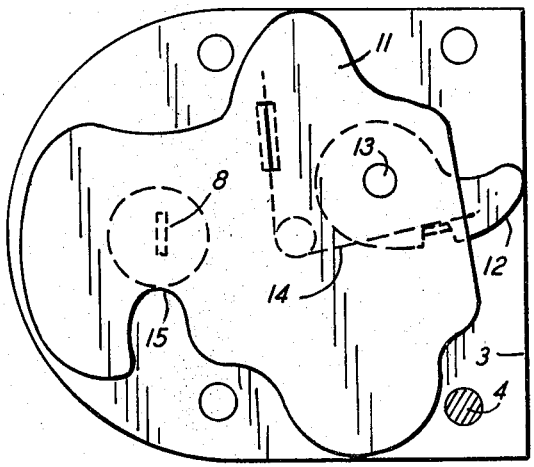
FIG. 4 is a plan schematic view of the side of the lock of FIG. 1 facing the door showing another embodiment of a protective device which is rotated by a cam and locked in the rotated position.

FIG. 4 shows an embodiment of a protective device in which the blind 11 is provided with a variable lift cam 12 which is rotatably fastened to the blind by the axle 13 and rotatable about the axle under action of a spring 14 engaging the blind and the cam. In the initial position of the blind 11, a recess 15 of the blind engages the connecting bar 8 urged by the cam 12 which is engaged against the wall 3 of the lock housing. When the bar 8 is removed, the blind permits the cam 12 to pivot on the axle 13 under action of the spring and the cam pushes the blind 11 sidewards to block the slot of the lock from which the bar 8 extended. The shape of the housing of the lock and the positions of its screws 4 determine the terminal position of the blind. The blind is locked in its terminal position by means of the cam 12, which engages the wall 3 of the lock housing at a right angle. The contours of the blind 11 are such that they permit movement of the blind from its initial position to its terminal position.

Figure 5:
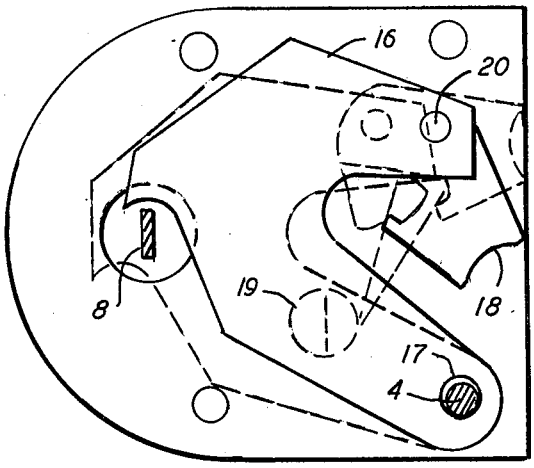
FIG. 5 is a plan schematic view of the side of the lock of FIG. 1 facing the door showing another embodiment of a protective device which is rotated about a screw of the lock by a cam and locked in the rotated position.

FIG. 5 shows an embodiment of a protective device in which the blind 16 is provided with a hole 17, through which one of the screws 4 of the lock passes. The blind 16 is also provided with a variable lift cam 18 rotatably fastened to the blind by axle 20 which is rotated by means of an Archimedean spiral spring 19 wound around an axle which is fastened to the blind. In the initial position of the blind, a recess of the blind 16 is urged against the connecting bar 8 and the cam 18 is pressed against the wall 3 of the lock housing by the spring 19 which engages the cam. When the bar 8 is removed, the blind 16 permits the cam 18 to rotate under action of the spring around its axle 20 and the cam in turn rotates the blind 16 about the screw 4. In the terminal position, the blind 16 blocks the slot from which the bar 8 has been removed. Another screw (unreferenced) of the lock determines the terminal position of the blind 16. The cam 18 locks the blind in the terminal position because the cam extends at a right angle relative to the wall 3 of the lock housing.

Figure 6:
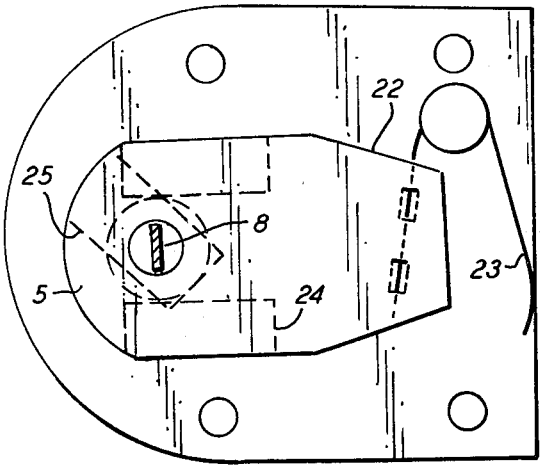
FIG. 6 is a plan schematic view of the side of the lock of FIG. 1 facing the door showing another embodiment of a protective device which is moved by a spring as directed by a cylindrical projection of the lock and locked in the moved position.
Figure 6A:
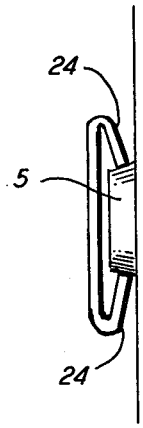
FIG. 6A is a side view of the lock of FIG. 6.

FIG. 6 shows an embodiment of a protective device in which the blind 22 is provided with a hole through which the connecting bar 8 passes. When the bar 8 is removed, the blind by means of the spring 23 fastened to the blind and engaging the wall of the lock housing is moved sidewards and is urged against the wall of the lock housing. As a result, the blind 22 obstructs the slot through which the connecting bar was inserted. The movement of the blind is directed by means of its bent edges 24 (FIG. 6A), which slide on the projection 5 of the lock. In its terminal position, the blind is locked by means of a flat spring 25, which is fastened with one of its ends on the blind and the other of its ends engaged by the projection 5.

Figure 7:
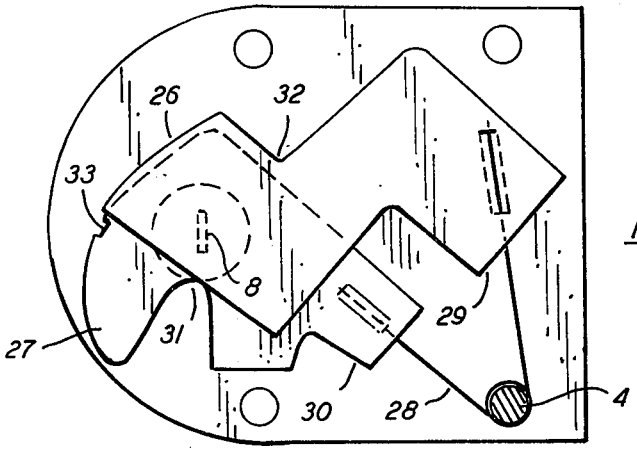
FIG. 7 is a plan schematic view of the side of the lock of FIG. 1 facing the door showing another embodiment of a protective device which uses blinds which are rotated by a spring about the screw of the lock and locked in their terminal positions.

FIG. 7 shows an embodiment of the protective device in which two blinds 26 and 27 are used, which are connected by a spring 28 respective legs 29 and 30 of which are fastened to a respective blind. A screw 4 of the lock is inserted through the coil of the spring. The protective device is inserted into the lock so that the connecting bar 8 engages respective recesses 31 and 32 of the blinds. When the connecting bar is removed, both blinds are rotated around the screw 4 in opposite directions and are placed in the terminal positions shown in the FIG. 7 obstructing the slot to prevent insertion of the connecting bar. The blinds are locked in their terminal positions by a tooth 33 on the blind 27 which engages the blind 26.

Figure 8:
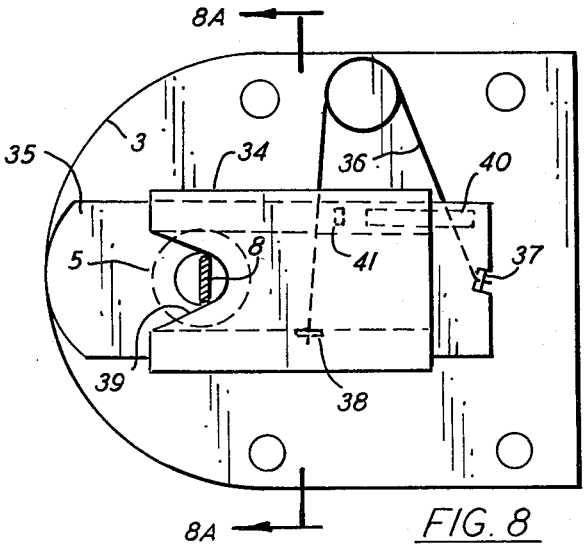
FIG. 8 is a plan schematic view of the side of the lock of FIG. 1 facing the door showing another embodiment of a protective device which uses two blinds, the movement of one of which is directed by a cylindrical projection of the lock and the other of which is directed by the one blind, both blinds being locked in their terminal positions by a spring.
Figure 8A:
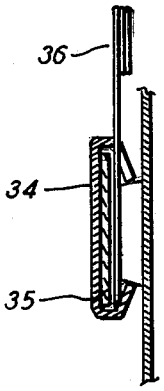
FIG. 8A is a section view taken along line A—A in FIG. 8 through the appraratus of FIG. 8.

FIG. 8 shows an embodiment of the protective device in which two blinds 34 and 35 are used which are connected by means of a spring 36. One end of the spring is free to move into engagement with lug 37 of the blind 35, and the other end of the spring is inserted into the lug 38 of the blind 34. The protective device is inserted into the lock so that the connecting bar 8 passes through the hole in the blind 35 and is engaged by the recess 39 of the blind 34. When the connecting bar is removed, the spring 36 pushes both blinds in opposite directions and they both obstruct the slot to prevent insertion of any tool. When the blind 34 is moved, it is directed by means of its bent edges (FIG. 8A) which slide on the projection 5 of the lock, and the blind 35 slides on the bent edges of the blind 34. In its terminal position, the blind 34 is urged against the wall 3 of the lock housing and is locked in this position by a flat spring 40, which engages a tooth 41 on the blind 35. FIG. 8 shows the initial position of the blinds, which are urged against the connecting bar 8.

Figure 9:
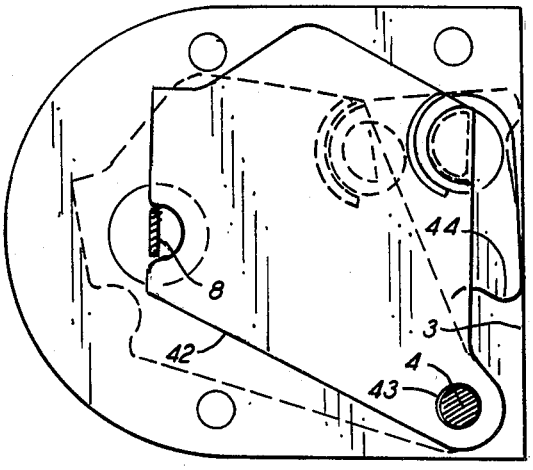
FIG. 9 is a plan schematic view of the side of the lock of FIG. 1 facing the door showing another embodiment of a protective device which is rotated about a screw of the lock by a spring and locked in the rotated position.

FIG. 9 shows an embodiment of the protective device in which a blind 42 is provided with a hole 43 and an Archimedean spiral spring 44 fastened to the blind. In the initial position, which is shown in solid lines, the blind is inserted into the lock so that the lock screw 4 passes through the hole 43 and the blind 42 is urged against the connecting bar 8 of the lock by the spring 44 which is engaged by the wall 3 of the lock housing. When the connecting bar is removed, the spring 44 straightens and pushes the blind to its terminal position shown in dotted lines, in which the blind obstructs the slot and prevents the insertion of any tool into the lock. In this terminal position, the blind is locked by the spring 44 because it extends at a right angle to and is engaged by the wall 3 of the housing.

Figure 10:
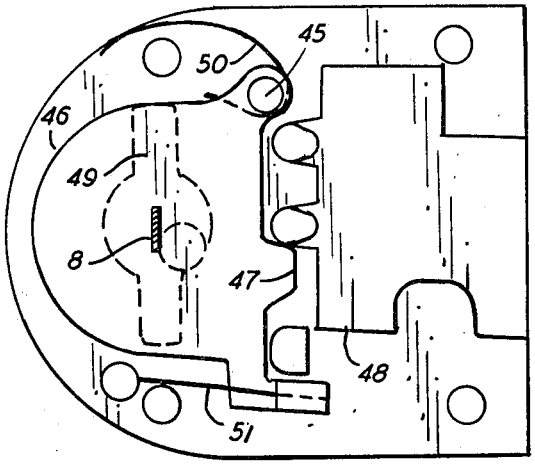
FIG. 10 is a plan schematic view of the side of the lock of FIG. 1 facing the door with the lock cover removed showing another embodiment of a protective device which locks the bolt of the lock by means of a disc with a tooth.

FIG. 10 shows an embodiment of protective device which locks the bolt of the lock when the connecting bar is removed. This protective device is placed into the housing of the lock where the mechanism of the bolt of the lock is disposed. The post 45 of the lock is used as an axle for the disc 46 which is provided with a tooth 47 which engages the bolt 48 of the lock to lock the bolt in place. This disc is placed on the cam 49 of the button of the lock between the cam and the cover of the lock housing, the cam 49 moving the bolt 48 when the connecting bar 8 is rotated. A spring 50 which is fastened on the disc 46 urges the disc against the connecting bar 8 of the lock, which is inserted through a hole in the disc. A spring 51 locks the disc when it is rotated around the axle 45 upon removal of the connecting bar.

Figure 11:
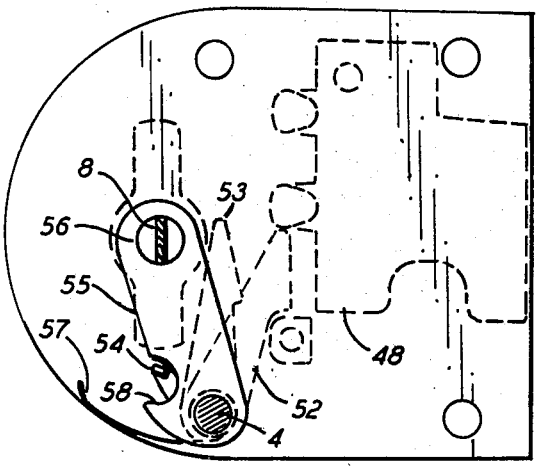
FIG. 11 is a plan schematic view of the side of the lock of FIG. 1 facing the door showing another embodiment of a protective device which locks the bolt of the lock by means of a pawl which is connected to a plate.

FIG. 11 shows another embodiment of a protective device for locking the bolt of the lock in which a lever 52 is placed into the lock housing in which the mechanism of the bolt of the lock is disposed rotatable about the lock screw 4. The lever 52 includes a lever arm 53 which acts as a pawl and locks the bolt of the lock when the lever 52 is rotated about the screw 4 to its terminal position, which is shown in dotted lines. A second arm of the lever is bent and provided with a tooth 54 which is inserted through a hole in the cover of the lock so that it projects into the space between the cover of the lock and the door. The second arm interacts with a plate 55 disposed in the space between the cover and the door which is also rotatable about the screw 4 and is provided with a hole 56 through which the connecting bar 8 of the lock is inserted. When the connecting bar is removed, the spring 57, which is fastened to the plate 55, pushes the plate 55 sidewards so that the projection 53 of the plate 55 engages the tooth 54 of the lever 52. As a result, the lever 52 is also rotated around the screw 4 and its lever arm 53 locks the bolt 48 of the lock.

Figure 12:
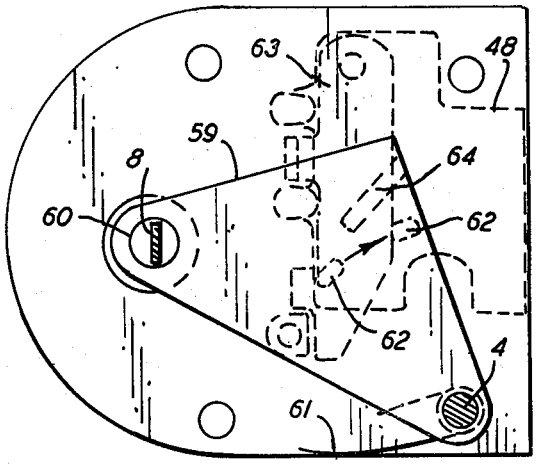
FIG. 12 is a plan schematic view of the side of the lock of FIG. 1 facing the door showing another embodiment of a protective device which locks a lever of the bolt mechanism to lock the bolt of the lock.

FIG. 12 shows another embodiment of the protective device which is placed between the lock and the door for locking the bolt of the lock. The plate 59 of the device is provided with a hole through which the screw 4 of the lock passes and about which the plate is rotatable. A hole 60 is provided in the plate through which the connecting bar 8 of the lock passes. When the connecting bar is removed, the plate 59 is pushed sidewards by spring 61. A tooth 62 on the plate 59 is inserted through a hole in the cover of the lock and moves in the direction of the arrow to the lower terminal position to lock the lever 63 and thereby lock the bolt 48 of the lock. The flat spring 64 which is fastened on the plate 59 is pressed against the door and pushes the plate 59 with its tooth 62 into the housing of the lock to lock the lever 63 and the bolt 48 of the lock.

Figure 13:
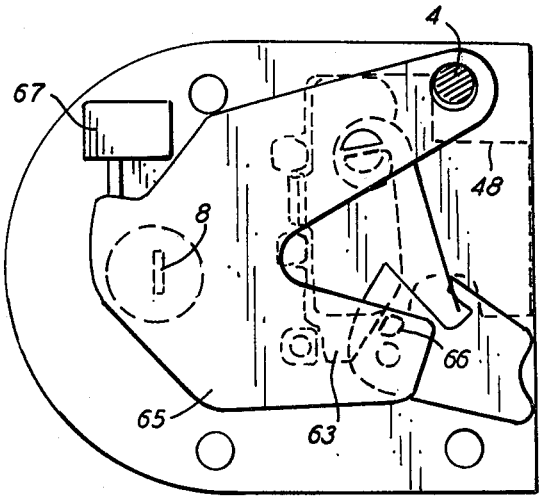
FIG. 13 is a plan schematic view of the side of the lock of FIG. 1 facing the door showing another embodiment of a protective device which obstructs the slot through which the connecting bar of the lock is inserted and also locks a lever which locks the bolt of the lock.

FIG. 13 shows an embodiment of a protective device which both obstructs the slot through which the connecting bar passes into the lock and locks the bolt of the lock when the connecting bar is removed. In addition, the device switches on sound apparatus having a dog's bark recorded for frightening a would-be intruder. This embodiment is the same as that in FIG. 5 except that the blind 65 is provided with a tooth 66 which is bent and passes through a hole in the cover of the lock. The blind is placed so that the tooth extends into the housing in which the mechanism of the bolt is disposed. Rotation of the blind 65 around the screw 4, when the connecting bar is removed, causes the bolt 48 of the lock to be locked by the lever 63, and by means of a contact 67, switching on of the sound apparatus. The blind 65 upon being pivoted obstructs the hole through which the connecting bar extended.

Intending to claim all novel, useful and unobvious features shown or described, I make the following claims:

1. Protective apparatus for a lock assembly including a housing, a bolt mechanism at least partially disposed in the housing, means separating the bolt mechanism which is in the housing from the exterior of the housing, the housing being adapted to be mounted to a structure with the means for separating facing the structure, a connecting bar extending into the housing past the means for separating when the lock assembly is mounted for use, the connecting bar being adapted to be coupled to and actuated by an exterior locking means, and means for coupling the connecting bar to the bolt mechanism to actuate the bolt mechanism upon actuation of the connecting bar by the exterior locking means, the protective apparatus being adapted to be removably coupled to the lock assembly and to cooperate with structure normally provided as part of the lock assembly when the lock assembly is mounted for use, the protective appartus comprising at least one plate-like element adapted to be mounted adjacent the means for separating between the means for separating and the structure to which the housing is adapted to be mounted when the lock assembly is mounted for use, the plate-like element being movable relative to the housing from a first position when the connecting bar extends to the coupling means to a second position when the connecting bar is separated from the coupling means, elastically deformable means acting in cooperation with at least part of said normally-provided lock assembly structure for moving the plate-like element relative to the housing from the first position to the second position, at least one of the plate-like element and the elastically deformable means engaging at least part of said normally-provided lock assembly structure in the second position so as to substantially prevent movement of the plate-like element from the second position to the first position when the lock assembly is mounted for use, the connecting bar when the lock assembly is mounted for use restraining movement of the plate-like element from the first position, the plate-like element when in the second position being operative to block access to the coupling means from the exterior of the housing from the side thereof facing entry of the connecting bar into the housing, whereby unauthorized actuation of the bolt mechanism can be prevented when the connecting bar has been separated from the coupling means.

2. The protective apparatus of claim 1 wherein the plate-like element is adapted to be mounted substantially in the housing with a substantial portion of the edge thereof exposed to the housing.

3. The protective apparatus of claim 1, wherein the plate-like element is adapted to be mounted entirely in the housing with a substantial portion of the edge thereof exposed to the housing.

4. The protective apparatus of claim 1, wherein the plate-like element includes means for pivotally mounting it relative to the housing.

5. The protective apparatus of claim 4, wherein the plate-like element includes an opening therein through which a pivot means is adapted to extend for pivotally mounting the plate-like element relative to the housing.

6. The protective apparatus of claim 5, wherein the pivot means comprises the shaft of a fastener normally provided with the lock assembly which extends into the housing when the lock assembly is mounted for use.

7. The protective apparatus of claim 1, wherein the plate-like element is configured and adapted to be positioned in the housing so that at least one edge thereof is adapted to be engaged directly by the housing in at least one of the first and second positions of the plate-like element.

8. The protective apparatus of claim 1, and comprising cam means pivotally connected to the plate-like element and engaged by the means for moving, the cam means being adapted to directly engage the housing for assisting in moving the plate-like element.

9. The protective apparatus of claim 1, wherein the means for moving is connected to the plate-like element and is adapted to be engaged in the housing.

10. The protective apparatus of claim 9, wherein the means for moving includes means for connecting the means for moving in the housing.

11. The protective apparatus of claim 9, wherein the plate-like element is configured and adapted to be positioned so that at least one edge thereof is adapted to be engaged directly by the housing in at least one of the first and second positions of the plate-like element, the protective apparatus including cam means pivotally connected to the plate-like element and engaged by the means for moving, the cam means being adapted to directly engage the housing for assisting in moving the plate-like element.

12. The protective apparatus of claim 8, wherein the cam means comprises another plate-like element pivotally connected to said plate-like element, said other plate-like element permitting movement of said plate-like element from the first to the second position thereof and being adapted to directly engage the housing when said plate-like element is in the second position and lock said plate-like element in the second position.

13. The protective apparatus of claim 1, and including means for slidably mounting the plate-like element in the housing.

14. The protective apparatus of claim 13, wherein the means for slidably mounting includes flanges extending from the plate-like element which are adapted to slidably engage the coupling means.

15. The protective apparatus of claim 14, wherein the means for moving is connected to the plate-like element and is adapted to directly engage the housing.

16. The protective apparatus of claim 1, and comprising first and second adjacently disposed plate-like elements movably interconnected by a spring, the spring comprising the means for moving and being adapted to move the first plate-like element into the second position when the connecting bar is separated from the coupling means.

17. The protective apparatus of claim 16, wherein the spring includes means for connecting it in the housing.

18. The protective apparatus of claim 16 and comprising means for slidably mounting one of the plate-like elements in the housing.

19. The protective apparatus of claim 18, wherein the means for slidably mounting the one plate-like element includes flanges extending therefrom which are adapted to slidably engage the coupling means.

20. The protective apparatus of claim 16, wherein the locking means comprise a projection on one of the plate-like elements which permits movement of the first plate-like element and which engages the other of the plate-like elements when the first plate-like element is in the second position, the second plate-like element being adapted to directly engage the housing to lock the first plate-like element in the second position in cooperation with the projection.

21. The protective apparatus of claim 1, wherein the locking means comprises a leaf spring fastened to the plate-like element which permits movement of the plate-like element from the first to the second position thereof and is adapted to engage the coupling means when the plate-like element is in the second position to lock the plate-like member in the second position.

22. The protective apparatus of claim 1, wherein the locking means comprises cam means pivotally connected to the plate-like element which permits movement of the plate-like element from the first to the second position thereof and is adapted to directly engage the housing when the plate-like element is the second position to lock the plate-like element in the second position.

23. The protective apparatus of claim 22, wherein the cam means comprises another plate-like element pivotally connected to said plate-like element.

24. The protected apparatus of claim 1, wherein the means for moving comprises a spring connected to the plate-like element and adapted to directly engage the housing in the second position of the plate-like element so as to lock the plate-like element in the second position.

25. The protective apparatus of claim 1, and further comprising an electric switch adapted to be mounted to the housing to be actuated by the plate-like element in the second position thereof.

26. The protective apparatus of claim 1, wherein the means for moving comprises a spring.

27. The protective apparatus of claim 26, wherein the spring comprises a hair-pin type spring having two arms, one of which acts on the plate-like element and the other of which acts on said structure which is fixed when the lock element is mounted for use.

28. The protective apparatus of claim 1, wherein the plate-like element when mounted in the housing has substantially all of its edge portions exposed to the housing.

29. The protective apparatus of claim 1, wherein the plate-like element when mounted in the housing is enclosed only by the housing.

30. A lock assembly comprising a housing, a bolt mechanism at least partially disposed in said housing, means separating the bolt mechanism which is in the housing from the exterior of the housing, the housing being adapted to be mounted to a structure with the means for separating facing the structure, a connecting bar extending into the housing past the means for separating when the lock assembly is mounted for use, the connecting bar being adapted to be coupled to and actuated by an exterior locking means, means for coupling the connecting bar to the bolt mechanism to actuate the bolt mechanism upon actuation of the connecting bar by the exterior locking means, and protective apparatus adapted to be removably coupled to the lock assembly and to cooperate with structure normally provided as part of the lock assembly when the lock assembly is mounted for use, the protective apparatus comprising at least one plate-like element adapted to be mounted adjacent the means for separating between the means for separating and the structure to which the housing is adapted to be mounted when the lock assembly is mounted for use, the plate-like element being movable relative to the housing from a first position when the connecting bar extends to the coupling means to a second position when the connnecting bar is separated from the coupling means, elastically deformable means acting in cooperation with at least part of said normally-provided lock assembly structure for moving the plate-like element relative to the housing from the first position to the second position, at least one of the plate-like element and the elastically deformable means engaging at least part of said normally-provided lock assembly structure in the second position so as to substantially prevent movement of the plate-like element from the second position to the first position when the lock assembly is mounted for use, the connecting bar when the lock assembly is mounted for use restraining movement of the plate-like element from the first position, the plate-like element when in the second position being operative to block access to the coupling means from the exterior of the housing from the side thereof facing entry of the connecting bar into the housing, whereby unauthorized actuation of the bolt mechanism can be prevented when the connecting bar has been separated from the coupling means.

31. In a lock assembly comprising a housing, a bolt mechanism at least partially disposed in said housing, means separating the bolt mechanism which is in the housing from the exterior of the housing, the housing being adapted to be mounted to a structure with the means for separating facing the structure, a connecting bar extending into the housing past the means for separating when the lock assembly is mounted for use, the connecting bar being adapted to be coupled to and actuated by an exterior locking means, and means for coupling the connecting bar to the bolt mechanism to actuate the bolt mechanism upon actuation of the connecting bar by the exterior locking means, the improvement comprising a protective apparatus adapted to be removably coupled to the lock assembly and to cooperate with structure normally provided as part of the lock assembly when the lock assembly is mounted for use, the protective apparatus comprising at least one plate-like element adapted to be mounted adjacent the means for separating between the means for separating and the structure to which the housing is adapted to be mounted when the lock assembly is mounted for use, the plate-like element being movable relative to the housing from a first position when the connecting bar extends to the coupling means to a second position when the connecting bar is separated from the coupling means, elastically deformable means acting in cooperation with at least part of said normally-provided lock assembly structure for moving the plate-like element relative to the housing from the first position to the second position, at least one of the plate-like element and the elastically deformable means engaging at least part of said normally-provided lock assembly structure in the second position so as to substantially prevent movement of the plate-like element from the second position to the first position when the lock assembly is mounted for use, the connecting bar when the lock assembly is mounted for use restraining movement of the plate-like element from the first position, the plate-like element when in the second position being operative to block access to the coupling means from the exterior of the housing from the side thereof facing entry of the connecting bar into the housing, whereby unauthorized actuation of the bolt mechanism can be prevented when the connecting bar has been separated from the coupling means.

32. The apparatus of claim 30 or 31, wherein the plate-like element is mounted substantially in the housing with a substantial portion of the edge thereof exposed to the housing.

33. The apparatus of claim 30 or 31, wherein the plate-like element is mounted entirely within the housing with a substantial portion of the edge thereof exposed to the housing.

34. The apparatus of claim 30 or 31, wherein the plate-like element includes means for pivotally mounting it relative to the housing.

35. The apparatus of claim 34, wherein the plate-like element includes an opening therein through which a pivot means extends for pivotally mounting the plate-like element relative to the housing.

36. The apparatus of claim 35, wherein the pivot means comprises the shaft of a fastener normally provided with the lock assembly which extends into the housing when the lock assembly is mounted for use.

37. The appparatus of claim 30 or 31, wherein the plate-like element is configured and positioned in the housing so that at least one edge thereof is engaged directly by the housing in at least one of the first and second positions of the plate-like element.

38. The apparatus of claim 30 or 31 and comprising cam means pivotally connected to the plate-like element and engaged by the means for moving, the cam means directly engaging the housing for assisting in moving the plate-like element.

39. The apparatus of claim 30 or 31, wherein the means for moving is connected to the plate-like element and is engaged in the housing.

40. The apparatus of claim 39, wherein the means for moving includes means for connecting the means for moving the housing.

41. The apparatus of claim 39, wherein the plate-like element is configured and positioned so that at least one edge thereof is engaged directly by the housing in at least one of the first and second positions of the plate-like element, the apparatus including cam means pivotally connected to the plate-like element and engaged by the means for moving, the cam means directly engaging the housing for assisting in moving the plate-like element.

42. The apparatus of claim 38, wherein the cam means comprises another plate-like element, said other plate-like element permitting movement of said plate-like element from the first to the second position thereof and directly engaging the housing when said plate-like element is in the second position to lock said plate-like element in the second position.

43. The apparatus of claim 30 or 31 and including means for slidably mounting the plate-like element in the housing.

44. The apparatus of claim 43, wherein the means for slidably mounting includes flanges extending from the plate-like element which slidably engage the coupling means.

45. The apparatus of claim 44, wherein the means for moving is connected to the plate-like element and directly engages the housing.

46. The apparatus of claim 30 or 31, and comprising first and second adjacently disposed plate-like elements movably interconnected by a spring, the spring comprising the means for moving and moving the first plate-like element into the second position when the connecting bar is separated from the coupling means.

47. The apparatus of claim 46, wherein the spring includes means for connecting it in the housing.

48. The apparatus of claim 46, and comprising means for slidably mounting one of the plate-like elements in the housing.

49. The apparatus of claim 48, wherein the means for slidably mounting the one plate-like element includes flanges extending therefrom which slidably engage the coupling means.

50. The apparatus of claim 46, wherein the locking means comprise a projection on one of the plate-like elements which permits movement of the first plate-like element and which engages the other of the plate-like elements when the first plate-like element is in the second position, the second plate-like element directly engaging the housing to lock the first plate-like element in the second position in cooperation with the projection.

51. The apparatus of claim 30 or 31, wherein the locking means comprises a leaf spring fastened to the plate-like element which permits movement of the plate-like element from the first to the second position thereof and engages the coupling means when the plate-like element is in the second position to lock the plate-like member in the second position.

52. The apparatus of claim 30 or 31, wherein the locking means comprises cam means pivotally connected to the plate-like element which permits movement of the plate-like element from the first to the second position thereof and directly engages the housing when the plate-like element is in the second position to lock the plate-like element in the second position.

53. The apparatus of claim 52, wherein the cam means comprises another plate-like element pivotally connected to said plate-like element.

54. The apparatus of claim 30 or 31, wherein the means for moving comprises a spring connected to the plate-like member and directly engaging the housing in the second position of the plate-like element so as to lock the plate-like element in the second position.

55. The apparatus of claim 30 or 31, and further comprising an electric switch mounted to the housing to be actuated by the plate-like element in the second position thereof.

56. The apparatus of claim 30 or 31, wherein the means for moving comprises a spring.

57. The apparatus of claim 56, wherein the spring comprises a hair-pin type spring having two arms, one of which acts on the plate-like element and the other of which acts on said structure which is fixed when the lock assembly is mounted for use.

58. The apparatus of claim 30 or 31, wherein the plate-like element when mounted in the housing has substantially all of its edge portions exposed to the housing.

59. The apparatus of claim 30 or 31, wherein the plate-like element when mounted in the housing is enclosed only by the housing.

60. The protective apparatus of claim 1 wherein the plate-like element engages a fastener normally provided with the lock assembly in at least one of the first and second positions of the plate-like element.

61. The protective apparatus of claim 11 wherein the plate-like element engages a fastener normally provided with the lock assembly in at least one of the first and second positions of the plate-like element.

62. The protective apparatus of claim 30 or 31 wherein the plate-like element engages a fastener normally provided with the lock assembly in at least one of the first and second positions of the plate-like element.

63. The protective apparatus of claim 37 wherein the plate-like element engages a fastener normally provided with the lock assembly in at least one of the first and second positions of the plate-like element.

* * * * *